US007763788B2

(12) United States Patent
Wachter

(10) Patent No.: US 7,763,788 B2
(45) **Date of Patent: *Jul. 27, 2010**

(54) CYMBAL MUTING SYSTEM

(76) Inventor: Martin Richard Wachter, 14025 Glenhein Rd., N. Phoenix, MD (US) 21131

( * ) Notice: Subject to any disclaimer, the term of this patent is extended or adjusted under 35 U.S.C. 154(b) by 58 days.

This patent is subject to a terminal disclaimer.

(21) Appl. No.: 12/221,281

(22) Filed: Aug. 1, 2008

(65) Prior Publication Data

US 2010/0024624 A1 Feb. 4, 2010

(51) Int. Cl.
*G10D 13/02* (2006.01)

(52) U.S. Cl. ..... 84/411 M

(58) Field of Classification Search ..... 84/411 M
See application file for complete search history.

(56) References Cited

U.S. PATENT DOCUMENTS

| | | | | | |
|---|---|---|---|---|---|
| 2,565,225 | A * | 8/1951 | Gladstone | 84/411 R |
| 3,597,520 | A * | 8/1971 | Andrews | 84/411 R |
| 4,037,509 | A * | 7/1977 | Slomovits | 84/422.3 |
| 4,102,235 | A * | 7/1978 | Le Masters | 84/411 R |
| 4,244,266 | A * | 1/1981 | Hardy | 84/411 M |
| 4,290,332 | A | 9/1981 | Schoeffling | |
| 4,325,280 | A * | 4/1982 | Hardy | 84/411 M |
| 4,325,281 | A * | 4/1982 | Hardy | 84/411 M |
| 4,581,973 | A * | 4/1986 | Hoshino | 84/723 |
| 4,776,254 | A * | 10/1988 | Cruz | 84/422.1 |
| 5,493,942 | A * | 2/1996 | Wolf | 84/411 R |
| 5,561,254 | A * | 10/1996 | Huffer | 84/411 M |
| 5,892,168 | A * | 4/1999 | Donohoe | 84/411 M |
| 5,892,169 | A * | 4/1999 | Shapiro | 84/411 M |
| 5,920,021 | A * | 7/1999 | Good | 84/411 M |
| 5,922,980 | A * | 7/1999 | Arteaga | 84/411 M |
| 5,929,354 | A * | 7/1999 | Davis | 84/411 P |
| 5,959,227 | A * | 9/1999 | Shapiro | 84/411 M |
| 6,686,528 | B1 | 2/2004 | Dicken | |
| 6,720,491 | B1 * | 4/2004 | Kroncke | 84/422.3 |
| 6,881,885 | B2 * | 4/2005 | Yoshino et al. | 84/402 |
| 7,408,103 | B2 * | 8/2008 | Wachter | 84/411 M |
| 7,498,499 | B2 * | 3/2009 | Sharp | 84/411 R |
| 7,638,701 | B2 * | 12/2009 | May, Jr. | 84/411 P |
| 2006/0065099 | A1 * | 3/2006 | Anderson | 84/411 M |
| 2010/0024624 | A1 * | 2/2010 | Wachter | 84/422.3 |

* cited by examiner

*Primary Examiner*—Jeffrey Donels
*Assistant Examiner*—Robert W Horn
(74) *Attorney, Agent, or Firm*—Max Stul Oppenheimer

(57) ABSTRACT

A percussion instrument is muted by using a dampening layer to reduce the sound and acousti vibrations when struck. In one embodiment, the dampening layer is comprised of a layer of flexible plastic adhered to a cymbal surface. When the cymbal is struck, the dampening layer dissipates the normal vibrations of the cymbal without hampering the natural look, feel, playability, or natural swinging motion of the cymbal. In a second, preferred, embodiment, the dampening layer is a sandwich of adhesive layers and plastic layers.

11 Claims, 13 Drawing Sheets

3M

468MP Transfer Tape

Product Data Sheet

Updated : November 2001
Supersedes : January 1999

Product Description

A-30 is a firm acrylic pressure-sensitive adhesive system. It features high ultimate bond strength with excellent high temperature performance and excellent solvent resistance. Bond strength increases substantially with natural ageing.

468 is a long ageing and resistant product used extensively by the nameplate industry.

Physical Properties
Not for specification purposes

| | | |
|---|---|---|
| **Adhesive Type** | Firm Acrylic | **3M ref** : A-30 |
| **Thickness** (ASTM D-3652)<br>Tape<br>Liner<br>Total | <br>130 µm 5 Thou<br>100 µm<br>230 µm | |
| **Release Liner** | Tan printed polycoated paper. | |
| **Tape Colour** | Clear | |
| **Shelf Life** | 24 months from date of despatch by 3M when stored in the original carton at 21°C (70°F) & 50 % Relative Humidity | |

Performance Characteristics
Not for specification purposes

| | | |
|---|---|---|
| **Adhesion to Stainless Steel**<br>ASTM D-3330 | 7.6 N/10mm | |
| **Shear Resistance** | High | |
| **Temperature Performance**<br>Max : Minutes / Hours<br>Max : Days / Weeks<br>Minimum | <br>204 °C<br>149 °C<br>-30 °C | |
| **Solvent Resistance** | Excellent. When the adhesive is properly applied to impervious materials, it will resist solvent attack and adhesive softening through edge contact with mild acids and alkalines, oils, grease, gasoline kerosene, JP-4 fuel, and many other standard aromatic and aliphatic solvents. However, it is not recommended for uses where continuous immersion is required. | |

FIG. 8a

Date : November 2001
468MP Transfer Tape

| | | | |
|---|---|---|---|
| **Performance Characteristics (Cont..)** Not for specification purposes | **UV Light Resistance** | Excellent. Will not oxidise when exposed to air or sunlight UV. | |
| | **Water Resistance** | Excellent. There are no evident adverse effects on the bond of properly applied materials after immersion in 21°C water for about 100 hours. | |
| **Additional Product Information** | 468MP is designed with a moisture resistant release liner which resists cockling or wrinkling from high humidity. Hi Performance No 468 is printed on the liner. | The 130 micron thick adhesive is ideally suited for joining materials that are relatively rough or thick materials with a small degree of residual stress. The peel strength of 468MP | is typically 30% higher than the 50 micron thick adhesive when measured on the same flat surface. It can by many times higher on embossed or textured surfaces. |
| **Application Techniques** | 1. Bond strength is dependent upon the amount of adhesive-to-surface contact developed. Firm application pressure develops better adhesive contact & thus improves bond strength.<br><br>2. To obtain optimum adhesion, the bonding | surfaces must be clean dry and well unified. A typical surface cleaning solvent is isopropyl alcohol & water. Use proper safety precautions for handling solvents.<br><br>3. Ideal tape application temperature range is 21°C to 38°C (70°F to 100°F). | Initial tape application to surfaces at temperatures below 10°C (50°F) is not recommended because the adhesive becomes too firm to adhere readily. However once properly applied low temperature holding is generally satisfactory. |
| **Applications** | 468MP is well suited for bonding together a wide variety of similar and dissimilar materials such as metals, paints, wood, glass and some plastics. | An excellent adhesive for mounting nameplates and decorative trim.<br><br>Miscellaneous joining and holding where a thin, long ageing bond is required. | Automotive Industry. |
| **Specifications** | This tape meets the requirements of U.S. Government specification MIL-P-19834, Amendment 1, Type 1. | 468MP is a UL and AGA recognised product. | |

3M is a trademark of the 3M Company.

Values presented have been determined by standard test methods and are average values not to be used for specification purposes. Our recommendations on the use of our products are based on tests believed to be reliable but we would ask that you conduct your own tests to determine their suitability for your applications.
This is because 3M cannot accept any responsibility or liability direct or consequential for loss or damage caused as a result of our recommendations.

3M

Tapes & Adhesives

© 3M United Kingdom PLC 1996

3M United Kingdom PLC
3M House,
28 Great Jackson Street,
Manchester,
M15 4PA

Product Information :
Tel 0870 60 800 50
Fax 0870 60 700 99

3M Ireland
3M House, Adelphi Centre,
Upper Georges Street,
Dun Laoghaire,Co. Dublin,
Ireland Customer Service :
Tel (01) 280 3555
Fax (01) 280 3509

FIG. 8b

Plastics

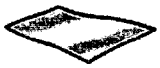

Part Number: 87875K37 $8.97 per Ft.

| | |
|---|---|
| Material | PVC |
| PVC Material | PVC, Type I |
| Backing | Plain Back |
| Shape | Film |
| Thickness | .08" |
| Thickness Tolerance | ±.004" |
| Length | Cut-to-Length |
| Maximum Continuous Length | 30' |
| Width | 48" |
| Width Tolerance | ±.25" |
| Film Type | Heavy-Duty |
| Film Application | Strip Doors, Sound-Deadening |
| Clear | Clear with No Tint |
| Operating Temperature Range | -10° to +150° F |
| Performance Characteristic | Weather Resistant |
| Tolerance | Standard |
| Specifications Met | Not Rated |

McMASTER-CARR.

FIG. 9

3M

Adhesive Transfer Tape

F-9465PC

Technical Data January, 2004

Product Description

3M™ Adhesive Transfer Tape F-9465PC is a 5 mil thick adhesive transfer tape which has been formulated for bonding to many flexible vinyls and to resist the effects of plasticizer migration in flexible vinyls.

Construction

| Product | 3M Tape F-9465PC |
|---|---|
| Adhesive Type: | Medium-Firm Acrylic |
| Release Liner: | Printed Tan Polycoated Paper Liner |
| Approximate Thickness: | |
| Release Liner: | .004 in. (0.10 mm) |
| Tape Only: | .005 in. (0.13 mm) |
| Tape Color: | Clear, slight amber tint |

Typical Physical Properties and Performance Characteristics

Note: The following technical information and data should be considered representative or typical only and should not be used for specification purposes.

| | |
|---|---|
| Adhesion to Steel: (ASTM D3330 72 hr. dwell) | 85 oz./in. width (88 N/100 mm) |
| Relative High Temperature Operating Ranges: | |
| Short Term: (minutes, hours) | 200°F (94°C) |
| Long Term: (days, weeks) | 160°F (74°C) |
| Relative Solvent Resistance: | Good |
| UV Resistance: | Excellent |

Available Sizes

| | |
|---|---|
| Available Lengths: | |
| Minimum | 60 yds. (54.9 m) |
| Maximum | 360 yds. (329.4 mm) |
| Available Widths: | |
| Minimum | 3/8 in. (9.5 mm) |
| Maximum | 54 in. (1371.6 mm) |
| Normal Slitting Tolerance: | ± 1/32 in. (0.8 mm) |
| Core Size (ID): | 3.0 in. (76.2 mm) |

Application Techniques

- Bond strength is dependent on the amount of adhesive-to-surface contact developed. Firm application pressure helps develop better adhesive contact and improve bond strength.
- To obtain optimum adhesion, the bonding surfaces must be clean, dry, and well unified.
- Ideal tape application temperature range is 70°F to 100°F (21°C to 38°C). Initial tape application to surfaces at temperatures below 50°F (10°C) is not recommended because the adhesive becomes too firm to adhere readily. However, once properly applied, low temperature holding is generally satisfactory

FIG. 10a

Adhesive Transfer Tape

F-9465PC

| | |
|---|---|
| **General Information** | **Note:** Vinyl formulations differ and plasticizer types and amounts can vary. The most common types of plasticized vinyl contain low molecular weight materials (plasticizers) which tend to migrate out of the vinyl. In the case of adhesive bonding, these plasticizers migrate into the adhesive which can cause softening of the adhesive and loss of bond strength over time.<br>• The possible effect of plasticizer migration on an adhesive bond can be predicted by accelerated aging for 5 days at elevated temperature (150°F [65°C]). **Note:** Due to the variability of vinyl formulations, we strongly recommend that the user test each vinyl substrate to determine suitability of the tape for the particular application.<br>• Natural and synthetic rubber materials such as neoprene and EPDM are also formulated with fillers and plasticizers. **Note:** 3M™ Adhesive Transfer Tape F-9465PC does not resist the effects of these particular fillers and plasticizers and **is not** recommended for use in bonding these materials. |
| **Storage** | Store in original cartons at 70°F (21°C) and 50% relative humidity. |
| **Shelf Life** | When stored under proper conditions, product retains its performance and properties for two years from date of manufacture. |
| **Precautionary Information** | Refer to Material Safety Data Sheet for health and safety information before using this product. For additional health and safety information, call 1-800-364-3577 or (651) 737-6501. |
| **For Additional Information** | To request additional product information or to arrange for sales assistance, call toll free 1-800-362-3550 or visit www.3M.com/adhesives. Address correspondence to: 3M Industrial Adhesives and Tapes Division, Building 21-1W-10, 900 Bush Avenue, St. Paul, MN 55144-1000. Our fax number is 651-778-4244. In Canada, phone: 1-800-364-3577. In Puerto Rico, phone: 1-787-750-3000. In Mexico, phone: 52-70-04-00. |
| **Product Use** | All statements, technical information and recommendations contained in this document are based upon tests or experience that 3M believes are reliable. However, many factors beyond 3M's control can affect the use and performance of a 3M product in a particular application, including the conditions under which the product is used and the time and environmental conditions in which the product is expected to perform. Since these factors are uniquely within the user's knowledge and control, it is essential that the user evaluate the 3M product to determine whether it is fit for a particular purpose and suitable for the user's method of application. |
| **Warranty and Limited Remedy** | Unless stated otherwise in 3M's product literature, packaging inserts or product packaging for individual products, 3M warrants that each 3M product meets the applicable specifications at the time 3M ships the product. Individual products may have additional or different warranties as stated on product literature, package inserts or product packages. 3M MAKES NO OTHER WARRANTIES, EXPRESS OR IMPLIED, INCLUDING, BUT NOT LIMITED TO, ANY IMPLIED WARRANTY OF MERCHANTABILITY OR FITNESS FOR A PARTICULAR PURPOSE OR ANY IMPLIED WARRANTY ARISING OUT OF A COURSE OF DEALING, CUSTOM OR USAGE OF TRADE. User is responsible for determining whether the 3M product is fit for a particular purpose and suitable for user's application. If the 3M product is defective within the warranty period, your exclusive remedy and 3M's and seller's sole obligation will be, at 3M's option, to replace the product or refund the purchase price. |
| **Limitation of Liability** | Except where prohibited by law, 3M and seller will not be liable for any loss or damage arising from the 3M product, whether direct, indirect, special, incidental or consequential, regardless of the legal theory asserted, including warranty, contract, negligence or strict liability. |

ISO 9001

This Industrial Adhesives and Tapes Division product was manufactured under a 3M quality system registered to ISO 9001 standards.

3M

Industrial Business
Industrial Adhesives and Tapes Division
3M Center, Building 21-1W-10, 900 Bush Avenue
St. Paul, MN 55144-1000

*Recycled Paper*
*40% pre-consumer*
*10% post-consumer*

Printed in U.S.A.
©3M 2004 70-0707-6156-7 (1/04)

FIG. 10b

Shape > Material > Thickness > Backing > Clear

Plastics

View catalog page 2 products match your selections

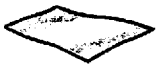

| | |
|---|---|
| Material | Polyester |
| Polyester Material | PET (Polyester) |
| Backing | Plain Back |
| Shape | Film |
| Thickness | .002" |
| Width | 40" |
| Film Type | Standard |
| Clear | Clear with No Tint |
| Lowest Temperature | -99° to -1° F |
| Highest Temperature | +201° to +300° F |
| Operating Temperature Range | -40° to +300° F |
| Performance Characteristic | High Tensile Strength and Weather Resistant |
| Tolerance | Standard |
| Specifications Met | Underwriters Laboratories (UL) |
| UL Rating | UL 94VTM2 |

Length

10' | 25'

These 2 products match your selections

| Length ▲ | | Each |
|---|---|---|
| 10' | 8567K22 | $19.25 |
| 25' | 8567K24 | 29.23 |

FIG. 11

CYMBAL MUTING SYSTEM

This application is entitled to, and claims the benefit of, priority from U.S. Provisional Application Ser. No. 60/572,537, filed May 19, 2004 and from U.S. Non-Provisional application Ser. No. 11/129,919, filed May 16, 2005.

FIELD AND BACKGROUND OF THE INVENTION

1. Field of the Invention

The present invention relates in general to percussion instruments, and more particularly to a novel method for muting the sound of a metal acoustic cymbal.

2. Background Information

Percussion cymbal instruments are a class of musical percussion instruments having a playing (usually upper) surface and a second (usually lower) surface, that are played by striking the playing surface with a stick or other implement, to produce a spectrum of sound caused by the vibrations of the cymbal.

The playing surface could be made from almost any material, although most percussion cymbal manufacturers use some type of metal alloy which is molded or die cut into various shapes and sizes, typically formed as a round disc with a mounting hole in the center. The mounting hole in the center permits the cymbal to be mounted centrally on a stand, allowing the cymbal to remain balanced. When struck, the cymbal will vibrate and swing on the stand in order to create its unique sound.

The purposes of muting the vibrations from a percussion cymbal instrument include A) reducing the sound level to allow playing or practicing without generating the full sound level and B) reducing direct acoustical sound when the cymbal is used as an electronic cymbal trigger, used to convert vibrations into electronic signals, so as to avoid interference with the electronically generated sound.

I provide here, a system for reducing the vibrations and muting the natural sounds of a percussion cymbal instrument.

The ideal design for a cymbal muting system would permit the cymbal to retain its normal characteristics (natural look, feel, playability, and natural swinging motion) while reducing the audible sound vibrations which occur when struck.

Current systems may cause the cymbal to become unbalanced and cumbersome to operate. Muting devices mounted on the playing surface of the cymbal change look, feel, and stick response of the instrument. Unbalanced striking surfaces require additional mechanisms to prevent the striking surface from unintentionally rotating and tipping over. The natural swinging motion of the cymbal may be reduced or eliminated Some devices result in the cymbals no longer looking like real cymbals. For examples of problems in the prior art, see U.S. Pat. Nos. 5,959,227 and 6,686,528 (which require cumbersome additional hardware), U.S. Pat. No. 5,959,227 (which requires the use of unbalanced devices mounted on the top playing surface of the cymbal), U.S. Pat. No. 6,686,528 (which reduces the natural swinging motion), and U.S. Pat. Nos. 4,037,509 and 5,561,254 (which change the color and appearance of the cymbal), all of which are incorporated herein by reference.

SUMMARY OF THE INVENTION

I have invented a better device for reducing the vibrations of percussion cymbal instruments.

The muting system comprises a flexible, preferably plastic, dampening layer and an adhesive layer to bond the flexible layer to the second surface of the cymbal. The plastic layer may comprise a centrally located hole in the center to permit the pass through or a typical mounting device or cymbal stand. The plastic layer can cover the entire second surface of the cymbal (save the mounting hole) or a portion of it. Ideally, the plastic layer would be the same outside diameter as the cymbal in order to maximize the dampening effect.

The adhesive layer is applied to one side of the plastic layer and then is bonded to the second surface of the cymbal. Means are provided for proper adhesion of the plastic layer to the metal surface of the cymbal as to allow easy removal and reuse of the muting system or a permanent bond, depending on the user's preference.

In accordance with another feature of the present invention, the flexible plastic layer can be made from a clear plastic material, allowing the natural color of the cymbal to be visible through the plastic muting layer. This layer provides a protective coating on the second surface of the cymbal, thus not affecting the playability or aesthetics of the playing surface. Although many materials could be used to provide this layer, I used a plasticized flexible PVC (polyvinyl chloride). The clear PVC plastic layer allows the second surface of the cymbal to appear unaffected as the natural surface of the cymbal is allowed to show through the clear layer.

In general I have found that 0.080" and 0.060" layers are preferable because they are a) readily available sizes b) not too thin as to limit the amount of vibration reduction, and c) not too thick as to change the weight and natural playability of the cymbal.

The vibration dampening device may be a ring-shaped gasket, which is preferably thick enough to limit the vibratory response of the cymbal, is transparent and does not change the balance of the cymbal when bonded to the cymbal. A suitable material is Poly Vinyl Chloride (PVC).

In addition, I have found that the durability and uniformity of the dampening is enhanced if a sandwich of at least two plastic layers is used, with an adhesive layer between the two plastic layers and an adhesive layer between one of the plastic layers and the cymbal.

The adhesive layer may be in the form of a double-sided transfer adhesive.

The advantages of my invention over previously invented vibration dampening systems include the following:

- It requires no additional mechanical devices to mute the sound.
- It allows the striking surface to remain balanced.
- It can be utilized with any cymbal striking surface including conventional metal cymbals.
- The clear plastic layer allows the natural color and shine of the original cymbal to show through.
- It is easy to apply and remove or it can be permanently attached.
- It can be used with standard cymbals and stands.
- It does not modify the playing surface.
- It allows the playing surface to exhibit natural playing characteristics such as free rotation, proper swing, and natural stick response.
- The sandwich-type embodiment provides greater durability than the single adhesive layer embodiment.

The objects of my invention are:

- To provide a cymbal muting device that does not interfere with the natural playing surface of a cymbal.
- To provide a cymbal muting device that does not interfere with the natural balance of a cymbal.
- To provide a cymbal muting device that maintains the natural color and aesthetics of the cymbal.

To provide a cymbal muting device that can be retrofitted onto existing cymbals.

To provide a cymbal muting device that allows permanent or temporary modification of a cymbal.

To provide a cymbal muting device which maintains uniform contact so as to provide durable and uniform muting over an extended period.

BRIEF DESCRIPTION OF THE DRAWINGS

The foregoing and still other objects of this invention will become apparent, along with various advantages and features of novelty residing in the present embodiments, from study of the following drawings, in which:

FIGS. 8*a* and 8*b* is a data sheet for 3M 468 MP transfer tape.

FIG. 9 is a data sheet for clear vinyl plastic.

FIGS. 10*a* and 10*b* is a data sheet for 3M 9465PC adhesive transfer tape.

FIG. 11 is a data sheet for 2 mil poly film.

DETAILED DESCRIPTION OF THE PREFERRED EMBODIMENT

A clear flexible PVC ring shaped device is attached to the underside of a cymbal using an adhesive that allows a bond of metal and PVC plastic. The clear PVC layer provides the dampening or muting effect by limiting the vibratory response of the cymbal while also allowing the natural surface of the cymbal to show through the transparent PVC material, thus a cymbal with my device attached will appear to have no device attached at all, but will have a limited vibratory response.

Figure 1:
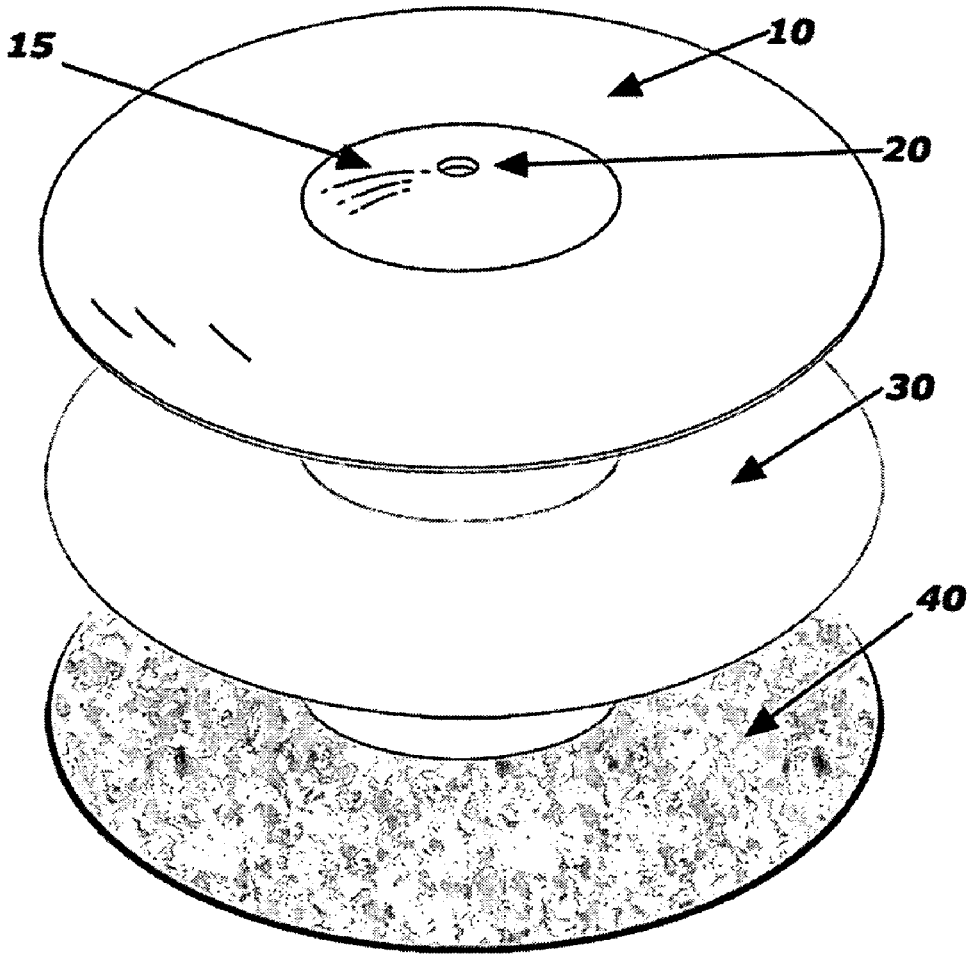
FIG. 1 is an exploded view of the cymbal muting system.

The components that make up my invention are as follows:

FIG. 1 shows a brass alloy cymbal 10 with a half-inch hole in the center 20 and a bell 15. The hole 20 located at the center of the bell 15, allows the cymbal to be centrally mounted by standard means known to those of ordinary skill in the art. A ring shaped layer of clear flexible PVC material 40 is bonded to the underside of the cymbal 10 by a thin layer of clear two-sided pressure sensitive adhesive 30. A 0.08 inch PVC material 40 with an outside dimension equal to that of the cymbal 10, inside dimension of the PVC material 40 equal to the diameter of the cymbal's bell 15 and 2 mil clear acrylic two-sided pressure sensitive adhesive has proved satisfactory.

Figure 2:
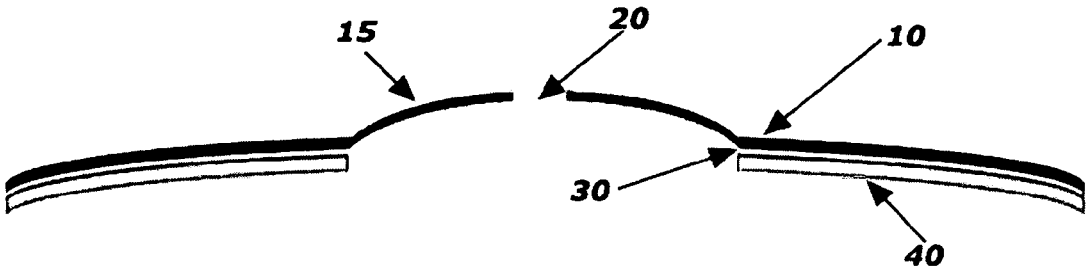
FIG. 2 is a cross section view from the side of the cymbal muting system.

FIG. 2 shows a cross section view of the cymbal 10 with the hole 20 and the bell 15. The adhesive layer 30 is sandwiched between the cymbal 10 and the PVC ring 40.

Figure 3:
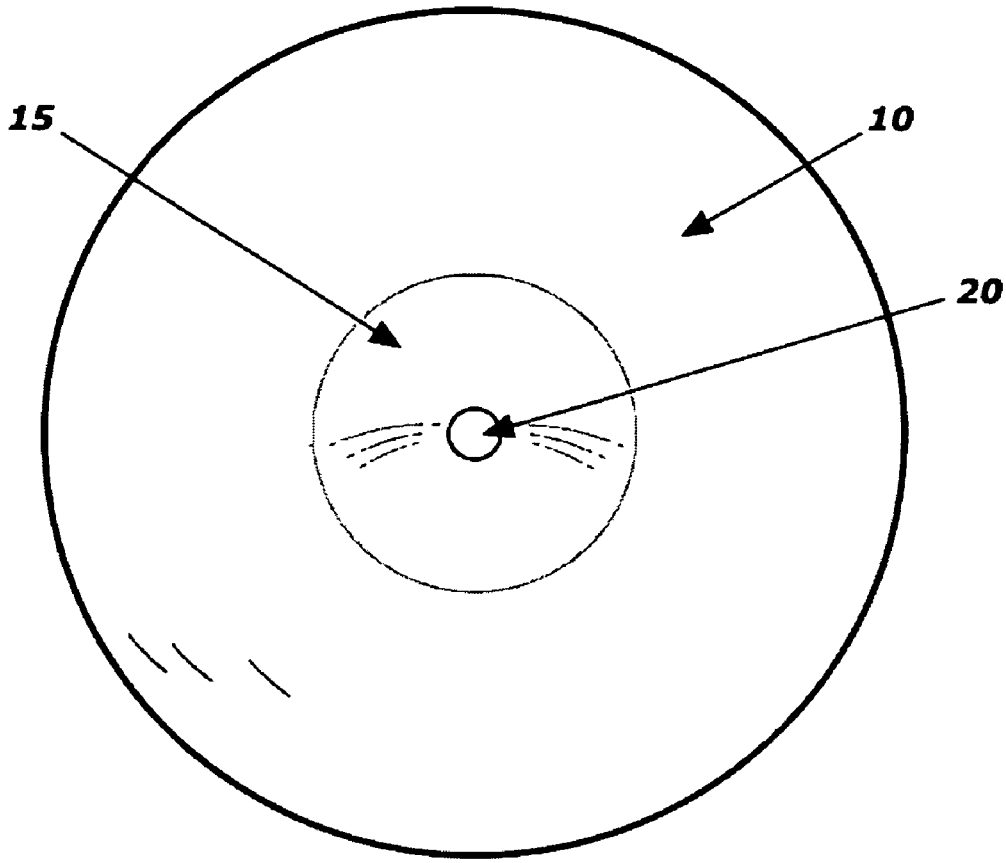
FIG. 3 is a top view of the cymbal muting system.

FIG. 3 shows a top view of the cymbal 10 with the center hole 20 and the bell 15. As you can see from this view, the muting system comprised of the clear PVC ring layer is not visible as it is bonded to the underside.

Figure 4:
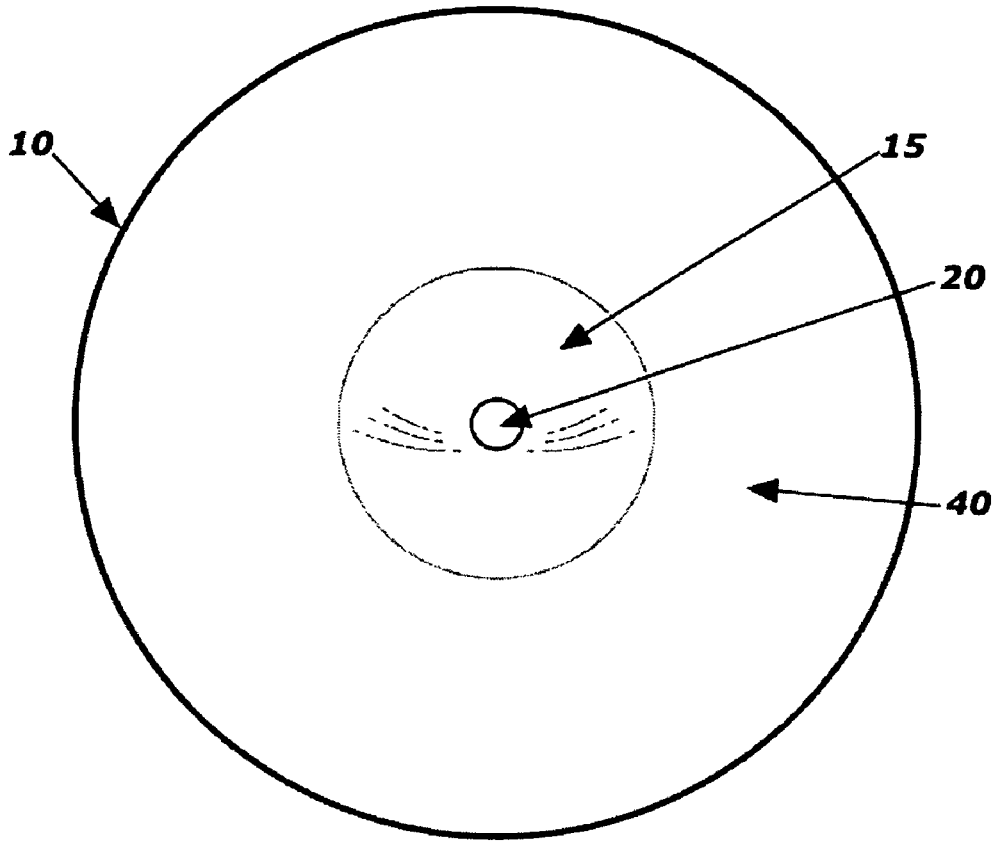
FIG. 4 is a bottom view of the cymbal muting system.

FIG. 4 shows a bottom view of the cymbal 10 with the hole 20 and the bell 15. From this bottom view you can see that the PVC ring 40 covers the underside of the cymbal 10, except for the bell 15. The PVC ring 40, being comprised of a clear PVC material, allows the natural surface and color of the cymbal 10 to be visible.

Figure 5:
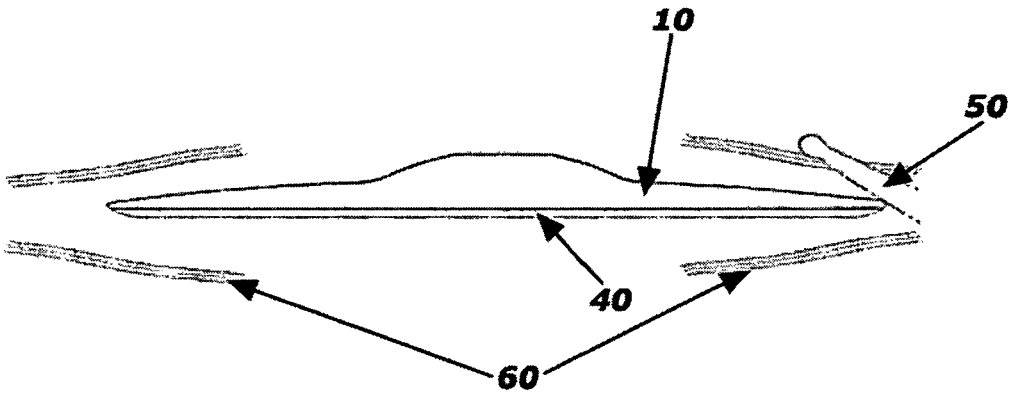
FIG. 5 is a side view of the cymbal muting system, showing reduced vibrations of the cymbal instrument.

FIG. 5 shows how the PVC material 40 acts as a vibration dampening system by minimizing vibrations 60 of the cymbal 10, when it is struck with a stick 50.

Figure 6:
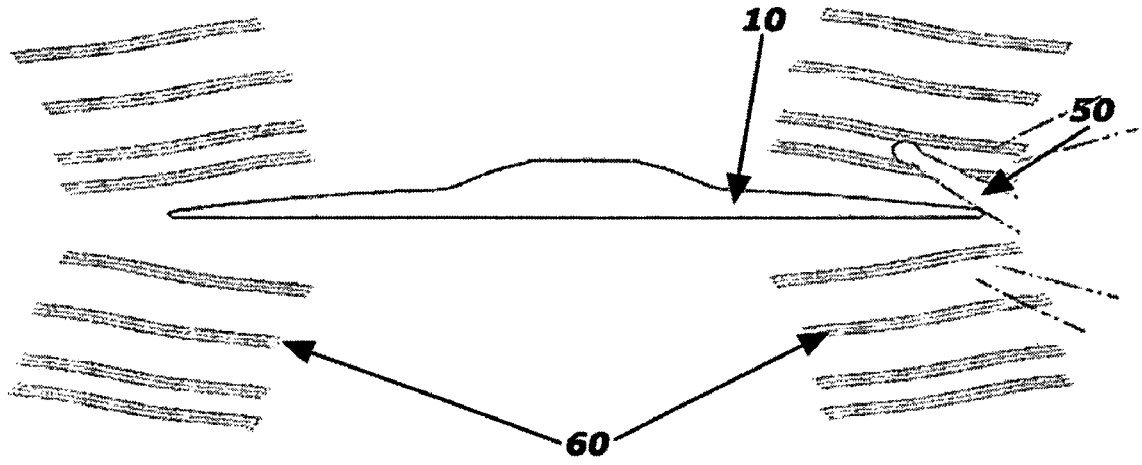
FIG. 6 is a side view of the prior art, showing the normal vibrations of a cymbal instrument.

FIG. 6 shows the prior art for a comparison of how the cymbal 10 will cause more vibrations 60 without the PVC ring layer, when it is struck with the stick 50. An experiment was conducted to measure the sound pressure level of a cymbal without a dampening layer versus the same cymbal with the dampening layer. The cymbal without the dampening layer was measured at 88 dB from a distance of one foot with a C weighted sound pressure level meter. The same cymbal with the dampening layer applied measured 72 dB from the same distance, using the same meter and meter settings.

While the preferred embodiment has been described, my invention could be produced using slightly different components and options. For example:

Although most metal cymbals are made from a brass or bronze alloy, any material that vibrates could be used to make the cymbal.

Although the cymbal used in my invention contains a bell, the bell is not required and cymbals without a bell may be used.

Although the PVC layer's outside diameters is the same as the cymbal's diameter, a different outside diameter could be used for either the cymbal or PVC layer. Although the inside dimension of the PVC ring matches the diameter of the cymbal's bell, the inside dimension of the PVC ring could be any size as long as it does not obstruct the cymbal's center mounting hole.

Although the PVC layer and cymbal are in the shape of a circle, any shape cymbal and any shaped PVC layer may be used.

Although the round striking surface of the cymbal is superior, any shaped striking surface for the cymbal may be used.

Although a clear acrylic pressure sensitive adhesive is a superior permanent bonding method, several methods of permanent, semi-permanent, or temporary adhesion means could be utilized to bond the PVC layer to the cymbal including epoxy, tape, rivets, screws, double sided adhesive tape, or glue.

Although the preferred embodiment mounting of the clear PVC layer to the bottom (i.e., second) surface of the cymbal is generally superior because it does not change the top (i.e., playing) surface, mounting the PVC layer to the top is also possible.

While effective, the application described above is subject to some disadvantages in that variances in the amount of plasticizer in a given part of the PVC layer, or chemical reactions over time between the adhesive and plasticizers in the layers may lead to partial or complete separation of layers or of the plastic from the metal cymbal thereby causing the entire dampening layer to become ineffective in reducing the vibratory response of the cymbal.

This problem may be solved by using a layered system, comprising two pieces of plastic and two different adhesive layers. A convenient way of providing the adhesive layers is to use adhesive transfer tape. Thus, a suitable sandwich of layers may be created as follows, as shown schematically in FIG. 7. Using this preferred method, instead of attaching the PVC vinyl plastic layer directly to the underside of the metal surface of the cymbal using a single adhesive layer, better adhesion is achieved by creating a sandwich in which a first adhesive layer (701) of adhesive designed to stick to metal on one side (3M 468MP, available from MMM Corporation, or any adhesive meeting the specifications indicated on FIG. 8 or equivalent, is suitable for this purpose) is attached to a first side of a polyester film layer (702) which is not as susceptible to separation from the adhesive due to its more rigid nature and lower plasticizer content. Specifications for a suitable polyester film are shown in FIG. 11. A second adhesive layer (703) of adhesive (3M 9465, available from MMM Corporation, or any adhesive meeting the specifications indicated on FIG. 10 or equivalent, is suitable for this purpose) is applied to a second side of the polyester film layer (702) and to a PVC vinyl layer (704), thereby creating a sandwich of adhesive layer-polyester film layer-adhesive layer-PVC layer which provides better adhesion compared to a simple PVC vinyl to metal bond used with a single adhesive layer. Specifications for a suitable PVC layer are shown in FIG. 9. While specific components which have been shown to be suitable are specified above, any material equivalent to the specifications provided in the respective figures may be substituted.

Figure 7:
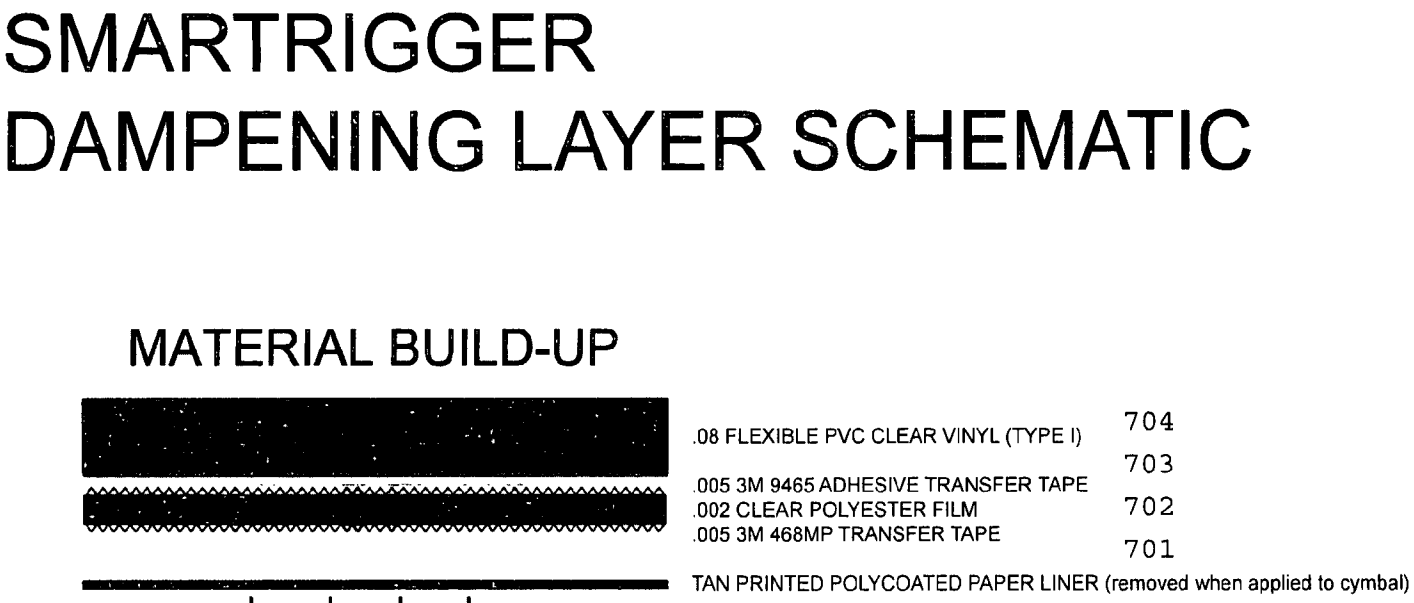
FIG. 7 is a schematic diagram of an enhanced layered system which is a preferred embodiment of the invention.

A device for muting a cymbal in which the cymbal has a first or playing surface, being the surface which is struck when the cymbal is played, and a second surface, and having a center mounting hole, is manufactured by forming a ring comprising a sandwich comprising first and second adhesive layers, a polyester film layer and a PVC layer, each of said layers having a first and second side (each side being the same, and the designations first and second side being used only to facilitate description of the structure of the sandwich), wherein the first side of the first adhesive layer is adhesively attached to the first side of the polyester film layer, the first side of the second adhesive layer is adhesively attached to the second side of the polyester film layer and the second side of the second adhesive layer is adhesively attached to the first side of the PVC layer as illustrated in FIG. 7. Thus formed, one side of the first adhesive layer is used to attach the sandwich to the cymbal. In the preferred embodiment, if 3M 468MP transfer tape is used, the side to be attached to the cymbal is covered with tan transfer paper which covers the adhesive until it is to be attached to the cymbal.

While a specific embodiment of the invention has been shown and described in detail to illustrate the application of the principles of the invention, it will be understood that the invention may be embodied otherwise without departing from such principles and that various modifications, alternate constructions, and equivalents will occur to those skilled in the art given the benefit of this disclosure. Thus, the invention is not limited to the specific embodiment described herein, but is defined by the appended claims.

What is claimed is:

1. A device for muting a cymbal, said cymbal having a first or playing surface, being the surface which is struck when the cymbal is played, and a second surface, and having a center mounting hole, comprising:

a ring of flexible dampening layer adhesively attached to the second surface so as to reduce the vibratory response of said cymbal to being struck, wherein said ring has an inside diameter D1 and an outside a diameter D2, and wherein the diameter D1 is no smaller than said cymbal's center mounting hole and the diameter D2 is no larger than the outside diameter of said cymbal and wherein said ring is bonded to the second surface of said cymbal by adhesive means and wherein said ring is thick enough to limit the vibratory response of said cymbal.

2. A device as set forth in claim 1 wherein said ring is transparent.

3. A device as set forth in claim 1 wherein said ring comprises Poly Vinyl Chloride.

4. A device for muting a cymbal, said cymbal having a first or playing surface, being the surface which is struck when the cymbal is played, and a second surface, and having a center mounting hole, comprising:

a ring of flexible dampening layer adhesively attached to the second surface so as to reduce the vibratory response of said cymbal to being struck, wherein said ring has an inside diameter D1 and an outside a diameter D2, and wherein the diameter D1 is no smaller than said cymbal's center mounting hole and the diameter D2 is no larger than the outside diameter of said cymbal and wherein said ring is bonded to the second surface of said cymbal by adhesive means and wherein said ring does not change the balance of said cymbal when bonded to said cymbal.

5. A device as set forth in claim 4 wherein the adhesive used for adhesively attaching the ring is an acrylic adhesive.

6. A device as set forth in claim 4 wherein the adhesive used for adhesively attaching the ring is transparent.

7. A device for muting a cymbal, said cymbal having a first or playing surface, being the surface which is struck when the cymbal is played, and a second surface, and having a center mounting hole, comprising:

a ring comprising a sandwich comprising first and second adhesive layers, a polyester film layer and a PVC layer, each of said layers having a first and second side, wherein the first side of the first adhesive layer is adhesively attached to the first side of the polyester film layer, the first side of the second adhesive layer is adhesively attached to the second side of the polyester film layer and the second side of the second adhesive layer is adhesively attached to the first side of the PVC layer.

8. A device as set forth in claim 7 wherein said ring is transparent.

9. A device as set forth in claim 7 wherein said ring is thick enough to limit the vibratory response of said cymbal.

10. A device as set forth in claim 7 wherein said ring does not change the balance of said cymbal when bonded to said cymbal.

11. A device as set forth in claim 7 wherein one of the adhesive layers comprises an acrylic adhesive.

* * * * *